US008360134B2

(12) United States Patent
Durham et al.

(10) Patent No.: US 8,360,134 B2
(45) Date of Patent: Jan. 29, 2013

(54) METHOD AND SYSTEM FOR EXTRACTING HEAT FROM METAL CASTINGS AND MOLDS

(75) Inventors: Philip M. Durham, New Boston, MI (US); Bradley D. Guthrie, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/901,772

(22) Filed: Oct. 11, 2010

(65) Prior Publication Data

US 2012/0085508 A1 Apr. 12, 2012

(51) Int. Cl.

| | |
|---|---|
| ***B22D 27/04*** | (2006.01) |
| ***B22D 15/00*** | (2006.01) |
| ***B22D 11/124*** | (2006.01) |
| ***B22D 27/02*** | (2006.01) |
| ***B22C 7/00*** | (2006.01) |

(52) U.S. Cl. ..... 164/125; 164/127; 164/236; 164/443; 164/348; 249/79

(58) Field of Classification Search ..... 164/125–128, 164/236, 443, 348, 371; 249/79, 122, 63
See application file for complete search history.

(56) References Cited

U.S. PATENT DOCUMENTS

| | | | | |
|---|---|---|---|---|
| 2002/0187217 | A1 * | 12/2002 | McDonald et al. | 425/547 |
| 2004/0161489 | A1 * | 8/2004 | Hwang et al. | 425/556 |
| 2009/0308563 | A1 * | 12/2009 | Lee | 164/340 |

* cited by examiner

*Primary Examiner* — Kevin P Kerns
*Assistant Examiner* — Steven Ha
(74) *Attorney, Agent, or Firm* — Joseph E. Root

(57) ABSTRACT

A method and system for eliminating near-surface porosity and surface tear defects in metal castings. The system includes a complex casting mold having at least one core pin or other regions susceptible to new surface porosity and surface tears. The system further includes a copper rod fused internally to the core pin to extract heat from a molten metal introduced in the mold. The copper rod extracts heat at a low thermal flux, preventing near surface porosity and surface tears. Moreover, the copper rod extracts heat from the hotter regions of the casting causing it to solidify at a rate comparable to the rate of solidification of other portions of the casting, thereby allowing uniform solidification of the casting.

6 Claims, 2 Drawing Sheets

METHOD AND SYSTEM FOR EXTRACTING HEAT FROM METAL CASTINGS AND MOLDS

BACKGROUND

This application relates generally to the field of metal casting and more particularly to methods for effectively cooling down casting materials.

Complex castings made of light metals, such as aluminum, typically face a number of heat related challenges that can adversely affect their quality. Two of these challenges are surface tears and near-surface porosity (voids). These casting challenges are related to the heat flow rate and total amount of heat that can be transferred from the casting material into their mold surfaces.

Surface tears typically develop when the temperature of the mold (e.g. steel) surface in contact with the molten casting increases. The increased temperature causes chemical dissolution of the mold surface with the molten casting. Upon casting solidification, parts of the mold surface may bond with the solid casting. This bond makes extraction of the casting difficult, which causes surface tears from the stress of extraction.

Porosity or voids in the casting occur due to metal shrinkage. For example, aluminum casting has a shrink rate of 5% in the molten state and 5% in solid state. Between the molten state and the solid state (i.e., during the solidification process), aluminum shrinks, forming porosity voids. These voids are formed in the region that solidifies last.

In complex castings, some casting regions might be thicker than others, and these areas solidify last. Moreover, to form holes in aluminum castings, "core pins" (solid cylindrical mold sections) are most commonly used. Molten aluminum is poured or injected around these pins and then solidified. In general, core pins absorb large amount of heat from the surrounding casting and are not able to expend this heat anywhere, making these mold elements one of the hottest regions in a mold. The aluminum casting in contact with the core pin solidifies last, causing near surface voids. These voids are usually exposed after the external cast surface is removed from machining.

To prevent surface tears, large amount of heat should be extracted from selected heavy cross-sectional areas of the casting. Similarly, to prevent near-surface porosity voids, a high rate of heat extraction should be obtained during solidification. By extracting a higher quantity of heat from the casting, the final solidification region can be pushed deeper into the casting, allowing formation of any potential shrinkage porosity deeper into the casting.

To combat these mechanical defects, a number of methods have been utilized in the past. In one such method, casters identify the highest temperature points in the mold using infra red heat detectors, and directly spray water on those regions. Although, this method brings down the mold temperature instantaneously, it may substantially harm the metal. Such a large temperature flux (ambient temperature of water is about 40 F and the temperature of hot steel is about 800 F) causes thermal stress, which over time develops into thermal fatigue, reducing the mold life considerably.

Another commonly used method places water lines ¾ of an inch away from the surface of the mold. This distance ensures that the heat flux is not too high at the mold-water interface. Water, however, does not conduct heat efficiently at this distance, resulting in ineffective cooling of the mold. A third method forces brief jets of water through the mold when the mold is under the highest heat load. Subsequently, an air circuit blows the water away. The water vaporizes immediately as it absorbs heat, this hot vapor is sucked out of the mold leaving it relatively cooler. This method is successful for small, inexpensive molds or core pins but cannot be used with complex, expensive casting molds.

Therefore, there exists a need for a device and method to cool castings and die molds (including core pins) effectively and to keep the temperature at the surface of the core pin relatively low in order to avoid near surface porosity and surface tears.

SUMMARY

One embodiment of the present application describes a device for effectively extracting heat from a casting mold. The device is made from a material with very high thermal conductivity, such as copper or silver, and this material is fused to hot (or thicker) regions of the casting mold that are susceptible to near-surface porosity or surface tears. The high thermal conductivity enables the device to extract heat from the casting and the mold rapidly, allowing faster solidification of thicker portions of the casting. The device further includes a cooling circuit, which transfers the heat from the device to outside the casting mold.

Another embodiment of the present disclosure describes a method for eliminating near-surface porosity and surface tear defects that affect metal castings. The method includes preparing a casting mold, introducing molten metal into the mold, and fusing copper to hot regions of the mold that are susceptible to porosity or surface tears prior to introducing the molten metal. The copper material is fused to the mold such that it extracts heat from the hot regions at a rate comparable to the rate of heat extraction from lighter regions of the casting to prevent uneven solidification of the metal casting, near surface porosity, and surface tears. Moreover, the copper extracts heat at a low thermal flux preventing thermal stress of the mold and the casting.

BRIEF DESCRIPTION OF THE DRAWINGS

The figures described below set out and illustrate a number of exemplary embodiments of the disclosure. Throughout the drawings, like reference numerals refer to identical or functionally similar elements. The drawings are illustrative in nature and are not drawn to scale.

DETAILED DESCRIPTION

The following detailed description is made with reference to the figures. Exemplary embodiments are described to illustrate the subject matter of the disclosure, not to limit its scope, which is defined by the appended claims.

Overview

Embodiments of the present disclosure relate to systems and methods for rapidly removing heat from a metal casting and its mold. The heat extraction enables improved cooling by maintaining temperature flux values within acceptable limits. The system disclosed here is described with the help of an example—an aluminum or aluminum—alloy casting molded in a steel or alloy-steel mold. It will be understood that this is merely exemplary and embodiments of the present disclosure may be utilized to extract heat from any suitable material, such as magnesium, magnesium alloys, iron-alloys, zinc alloys, etc. Moreover, the system may be utilized in any suitable casting process, such as high-pressure die casting, squeeze casting, semi-solid casting, or permanent mold casting without departing from the scope of the present disclosure.

EXEMPLARY EMBODIMENTS

Figure 1:
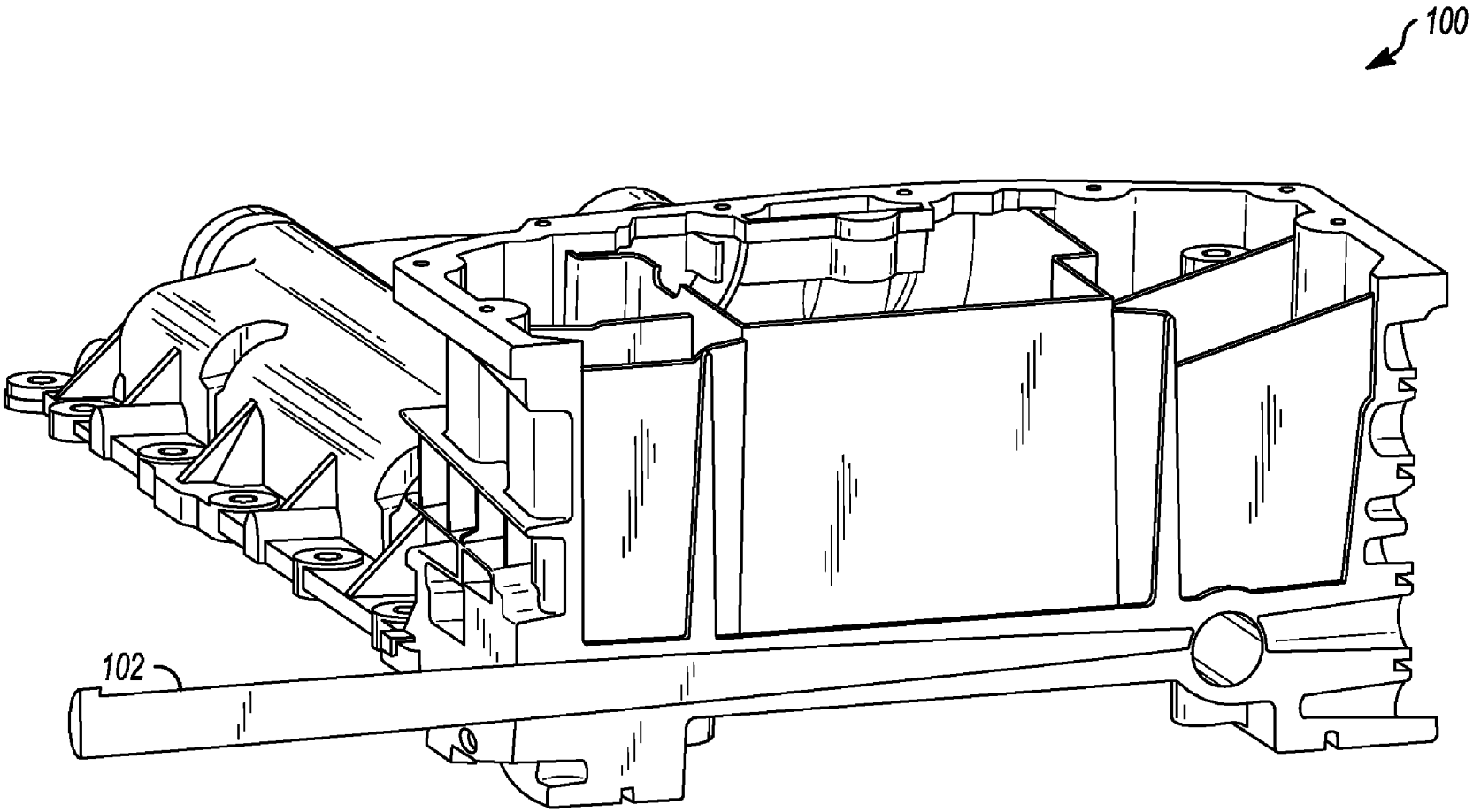
FIG. 1 is an isometric view of an exemplary casting mold where embodiments of the present disclosure may operate.

FIG. 1 illustrates an exemplary complex die-casting mold 100, where embodiments of the present disclosure may operate. Complex aluminum castings, such as vehicle doorframes, or bodies are commonly die-casted using similar molds. As seen, the mold is elaborate, thicker in some portions, and thinner in others. Moreover, to make holes in the casting, some molds may include core pins, such as a core pin 102. Molten aluminum is poured or injected into the mold 100 and then over time, the molten aluminum solidifies, forming an aluminum casting. The casting may be removed from the mold 100 and machined.

As described previously, near surface porosity voids usually develop near the contact surface between the core pin 102 and the aluminum casting because this region solidifies last. Moreover, heat flow from the molten aluminum heats up the core pin 102 considerably. At such high temperatures, the steel may blend with the molten aluminum, and on solidification, the steel may bond to the aluminum, causing surface tears. In addition to the core pin 102, other thicker portions of the casting also cool down slower than the lighter portions, causing uneven solidification of the casting. The portions that solidify later will have more voids than the lighter portions, resulting in varied mechanical properties across the casting.

Embodiments of the present disclosure fuse a high heat-conducting material to the core pin or other high-temperature regions of the steel mold to allow effective heat dissipation. One such material, copper, has a thermal conductivity index of about 223 BTU/(hr·ft·° F.), which is approximately 14.8 times greater than alloy-steels. Therefore, a copper rod fused to the mold 100 can rapidly draw a high amount of heat from the casting and the mold 100, resulting in a relatively low thermal flux within the mold steel. This rapid heat extraction rate enables faster cooling of thicker sections of the casting (almost equal to the cooling rate of lighter sections), resulting in uniform solidification of the casting.

Figure 2:
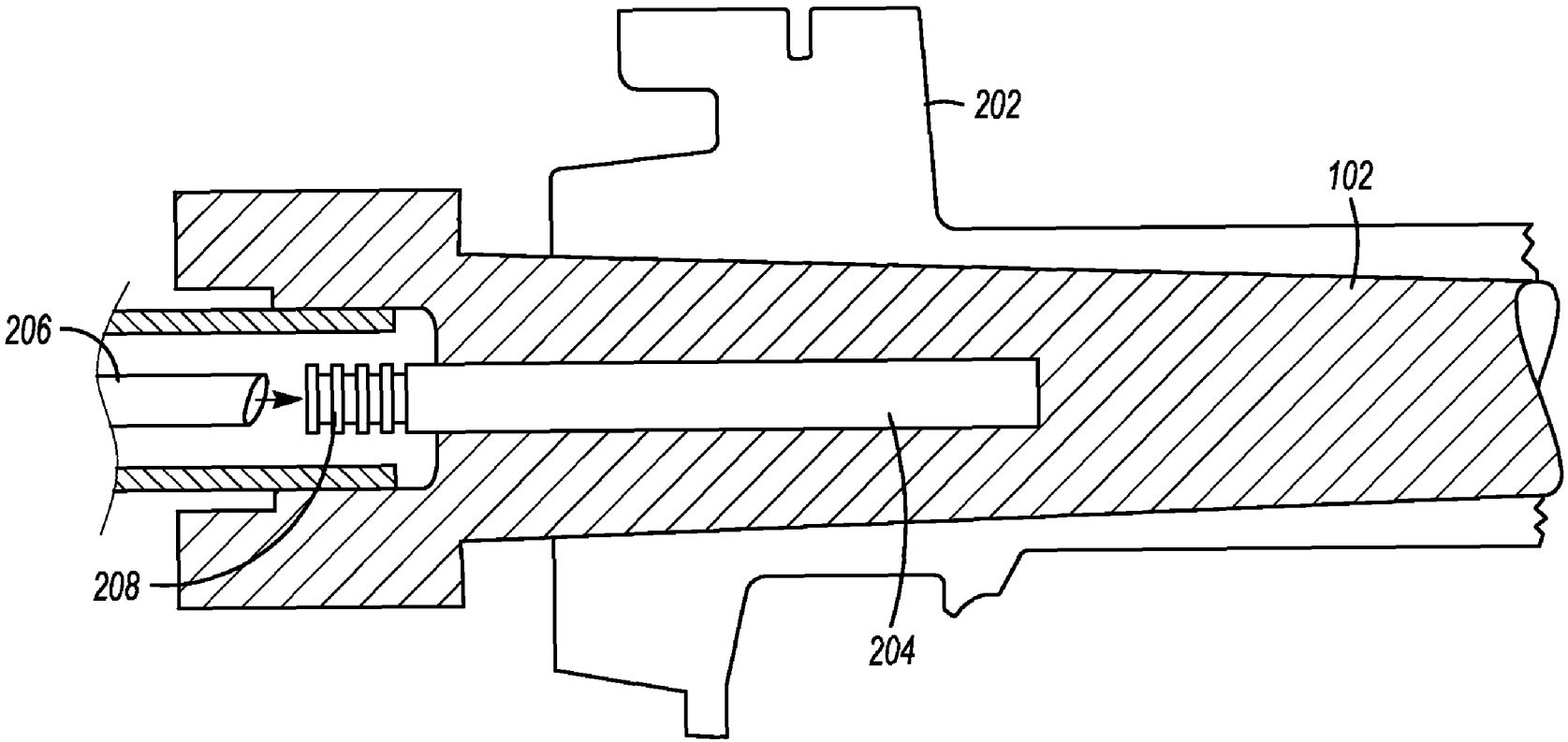
FIG. 2 is a cross-section of an exemplary mold core pin according to embodiments of the present disclosure.

FIG. 2 is a cut-away cross-section of the mold 100 where embodiments of the present disclosure rapidly extract heat. The figure illustrates the core pin 102, such as a steel alloy core pin, surrounded by a casting, such as an aluminum casting 202. A copper rod 204 having a substantially smaller radius than the core pin 102, is internally fused to the core pin 102. The copper rod 204 being highly conductive enables heat flow from the core pin 102 and the surrounding casting 202, cooling them down rapidly. The copper rod 204 may extract heat from the casting at a rate of 7 to 15 times greater than the parent mold steel 102.

Further, a part of the copper rod 204 extends slightly from the core pin 102. To avoid temperature increases in the copper rod 204, heat is transferred from the copper rod 204 to a suitable cooling circuit 206, such as a water pipe, so that the heat may be carried outside the casting mold 100. By extending the end of the copper rod 204 into a liquid cooling circuit 206, the heat carried by the copper rod 104 can be transferred into the transport medium (e.g., water, air, or nitrogen gas) by way of convection, thereby transporting the heat outside of the casting mold 100. In this example, the transport medium of the cooling circuit 206 is assumed as water. It will be understood that other suitable cooling circuits may also be used such as air cooling circuits, or nitrogen cooling circuits, without departing from the scope of the claimed invention. Alternative gaseous transport mediums must be accounted for (e.g., capacity to transfer heat convectively) such that the protrusion length and shape factor of the copper rod 204 can be determined for balancing the convective heat transfer rate.

A hole may be drilled in the core pin 102 to insert the copper rod 204. The copper rod 204 may then be fused to the core pin 102 using a number of techniques. One such technique may be soldering, using a highly conductive material, such as silver. Alternatively, the copper rod 204 may be brazed to the steel core pin 102. The solder provides a very high heat conductive path from the die steel to the copper rod 204. For effective heat extraction, the soldering should seal the copper rod 202 to the core 102, leaving no gaps or air pockets, which could act as conductivity resistors.

Being a good thermal conductor, the copper rod 204 heats up to a temperature much higher than steel, and conducts the heat away from the casting-die interface. Furthermore, the copper rod 204 extracts the heat from the casting at a much lower thermal flux than traditional methods, such as water-cooling, because the temperature difference between the hot copper rod 204 and the molten aluminum is small as compared to the temperature difference between molten aluminum and water. This low thermal flux prevents thermal stress and consequently prevents thermal fatigue of the mold 100.

Cylindrical fins 208 may be added to the distal end of the rod 204 to increase the surface area at the heat transfer interface (between the rod 204 and cooling circuit 206). This additional surface area increases the heat transfer rate by either natural convection or forced convection or a combination of both methods. The heat energy transferred by convection is a function of the heat transfer coefficient, temperature difference, and the surface area in contact.

Heat extraction through the copper rod 204 effectively keeps the die steel cool during the solidification process, causing dendrites to be formed more rapidly in that area, thereby driving porosity (voids) deeper into the aluminum casting 202. When the aluminum casting 202 is removed and the hole around the core pin 102 is machined out, porosity is greatly reduced.

Here, the copper material is formed as a rod. It will be understood however, that the copper may be formed in any shape without departing from the scope of the present disclosure. For example, in other thicker regions of the mold 100, the copper may be shaped as plates, wires, blocks, or any other shape, which may be fused to the mold walls.

The specification has set out a number of specific exemplary embodiments, but those skilled in the art will understand that variations in these embodiments will naturally occur in the course of embodying the subject matter of the disclosure in specific implementations and environments. It will further be understood that such variation and others as well, fall within the scope of the disclosure. Neither those possible variations nor the specific examples set above are set out to limit the scope of the disclosure. Rather, the scope of claimed invention is defined solely by the claims set out below.

We claim:

1. A system for eliminating near-surface porosity and surface tear defects in metal castings, the system comprising:

a casting mold having a core pin;

a molten metal introduced in the casting mold for casting;

a copper rod fused internally to the core pin for extracting heat from the molten metal and the casting mold, wherein the copper rod extends out of the core pin, and the end of the copper rod extending out of the core pin includes one or more cylindrical fins.

2. The system of claim 1, wherein the copper rod is fused to the core pin using silver solder.

3. The system of claim 1, wherein the copper rod is fused to the core pin by brazing.

4. The system of claim 1, wherein the metal casting is made of at least one of aluminium, aluminium alloy, magnesium alloy, or zinc alloy.

5. The system of claim 1, wherein the casting mold is made of at least one of steel, alloy steel or iron.

6. The system of claim 1 further comprising a cooling circuit, wherein the cooling circuit is an air-cooling circuit, a nitrogen cooling circuit or a water cooling circuit.

* * * * *